US005390726A

United States Patent [19]

Fukuda et al.

[11] Patent Number: 5,390,726

[45] Date of Patent: Feb. 21, 1995

[54] PROCESS FOR PRODUCING THIN METALLIC STRIP BY CONTINUOUS CASTING

[75] Inventors: Yoshimori Fukuda, Futsu; Kensuke Shimomura; Takashi Arai, both of Hikari, all of Japan

[73] Assignees: Nippon Steel Corporation; Mitsubishi Jukogyo Kabushiki Kaisha, both of Tokyo, Japan

[21] Appl. No.: 117,173

[22] PCT Filed: Mar. 15, 1991

[86] PCT. No.: PCT/JP92/00316

§371 Date: Sept. 14, 1993

§102(e) Date: Sept. 14, 1993

[87] PCT Pub. No.: WO92/16323

PCT Pub. Date: Oct. 01, 1992

[30] Foreign Application Priority Data

Mar. 15, 1991 [JP] Japan ..... 3-051202

[51] Int. Cl.[6] ..... B22D 11/04; B22D 11/06

[52] U.S. Cl. ..... 164/478; 164/480

[58] Field of Search ..... 164/480, 428, 478, 416

[56] References Cited

FOREIGN PATENT DOCUMENTS 62-16853 1/1987 Japan .

64-40148 2/1989 Japan .

3-174954 7/1991 Japan .

*Primary Examiner*—Kuang Y. Lin

*Attorney, Agent, or Firm*—Kenyon & Kenyon

[57] ABSTRACT

A process for producing a thin metallic strip by continuous casting, comprising forming a pouring basin portion for a molten metal between a pair of rotary cooling drums respectively having shafts parallel to each other and a pair of side gates in contact with the end faces of the cooling drums and pouring molten metal into the pouring basin portion for molten metal to continuously cast a thin cast strip, characterized in that the casting is conducted while vibrating the side gates at a frequency, f (Hz), determined according to the following formula in a direction substantially horizontal to an imaginary line formed by connecting the shaft centers of the cooling drums to each other:

$$aA+b+cV \leqq f \leqq 50 \quad (1)$$

wherein

A is the numerical value of the amplitude (mm) of the side gate at the kissing point portion of the cooling drum and is in the range of from 0.5 to 5 mm;

V is the numerical value of the casting rate (m/min) previously determined from a desired casting sheet thickness; and a=2, b=5, and c=0.1.

2 Claims, 6 Drawing Sheets

PROCESS FOR PRODUCING THIN METALLIC STRIP BY CONTINUOUS CASTING

DESCRIPTION

Technical Field

The present invention relates to a process for producing a thin metallic strip by continuous casting in a twin drum system and particularly to a method of vibrating a side gate constituting a pouring basin portion.

Background Art

A conventional continuous casting process using a twin drum system comprises forming a pouring basin portion for a molten metal comprising a pair of rotary cooling drums respectively having shafts parallel to each other and a pair of side gates respectively in contact with the end face of the cooling drums, solidifying the molten metal poured into the pouring basin at a stage leading to the kissing point while cooling the molten metal by means of the cooling drums, thereby forming a thin cast strip, and pulling the cast strip downward.

In casting a thin strip by the above-described process, a gap often occurs between the end face of the cooling drum and the side gate in press contact with the end face of the cooling drum. In this case, the molten metal enters the gap, or solidified matter adheres to the surface of the side gates and grows, so that it frequently becomes difficult to conduct casting due to the breaking of a solidified shell or entrainment on the cooling drum attributable to the formation of casting fins.

In order to solve this problem, Japanese Unexamined Patent Publication (Kokai) No. 60-166146 discloses a method of vibrating the side gates in the horizontal direction.

Since, however, the object of the technique disclosed in the above-described document is to remove solidified matter solidified and grown on the surface of the side gates, the proper range of reciprocating movement of the side gates in the horizontal direction is as follows.

1 cycle: 0.25 to 5.0 sec degree of movement in each direction, from rest position: 5 to 20 mm Specifically, the amplitude of the said gate vibration is in the range of from 10 to 40 mm, and the number of vibrations per se (frequency) is in the range of from 5 to 0.2 Hz. That is, the above-described technique is characterized in that the vibration is conducted slowly but with a large amplitude.

The present inventors have conducted various studies on the above-described technique and, as a result, have found that although such means is effective in preventing the formation of casting fin, a delay of solidification of the molten metal occurs at the end portion of the cooling drum to form a porosity and a large secondary casting fin.

Specifically, when the amplitude of the side gate becomes large, a shell which is growing on the cooling surface of the drum is unfavorably floated from the cooling drum by shearing stress, which delays the development of the shell, so that there occurs a delay in solidification.

An object of the present invention is to remove solidified matter formed on the side gates and to prevent the delay of solidification at the end portion of the cooling drum.

SUMMARY OF THE INVENTION

In order to attain the above-described object, the present invention has the following constitution. Specifically, the present invention is directed to a process for producing a thin metallic strip by continuous casting, comprising forming a pouring basin portion for a molten metal between a pair of rotary cooling drums respectively having shafts parallel to each other and a pair of side gates in contact with the end face of said cooling drums and pouring said molten metal into said pouring basin portion for a molten metal to continuously cast a thin strip, characterized in that a side gate frequency, f (Hz), is determined according to the following formula (1) using the initial numerical value (in the range of from 0.5 to 5 mm) of a side gate amplitude, A, at a kissing point of said pouring basin portion for a molten metal and the numerical value of the casting rate, V (m/min), previously determined from a target sheet thickness of a cast strip and casting is conducted while vibrating said side gates at the determined frequency, f, at an amplitude, A:

$$aA+b+cV \leqq f \leqq 50 \quad (1)$$

The range of the side gate amplitude, A, is determined so that the occurrence of casting fin and the delay of solidification can be avoided. The casting rate, V, is limited, as one of the casting conditions, to a particular range for each apparatus and is continuously measured by means of a casting rate detector provided on, for example, a shaft of the drum, and when the casting rate is varied, at least one of the amplitude and the frequency of the side gate vibration is adjusted according to the formula (1) .

In the above-described formula (1), a=2, b=5, and c=0.1.

BEST MODE FOR CARRYING OUT THE INVENTION

The best mode for carrying out the invention will now be described in detail.

Figure 4:
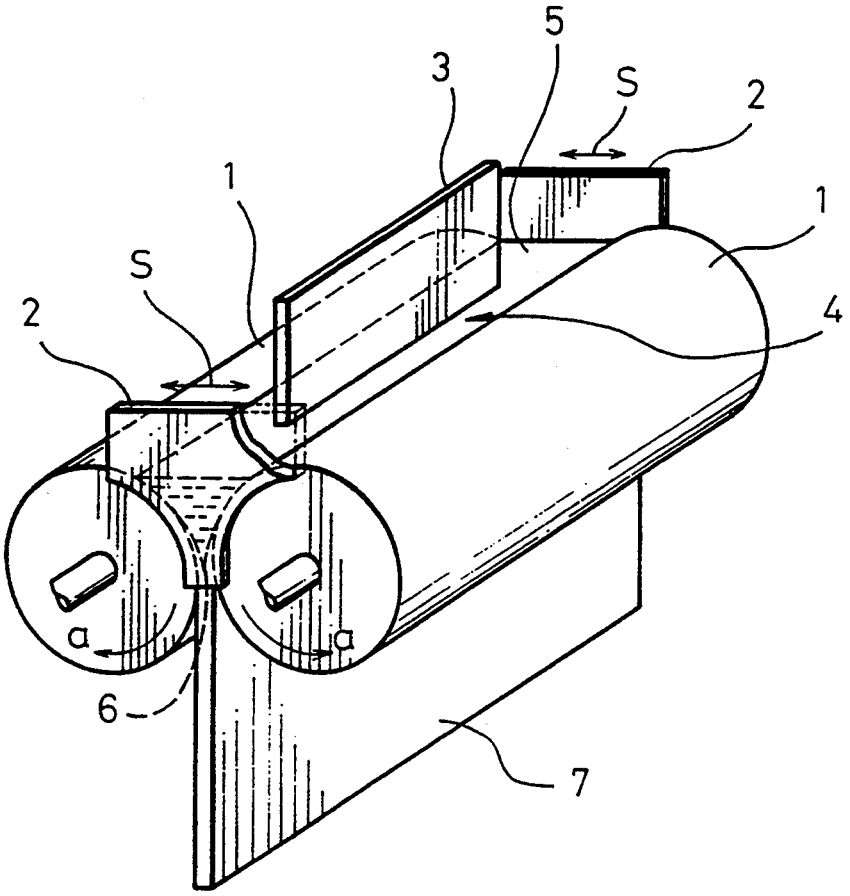
FIG. 4 is a perspective diagram showing the state of practice of the present invention.

At the outset, an embodiment of the present invention will be described with reference to FIG. 4. In the present invention, use is made of a casting apparatus shown in FIG. 4, that is, a casting apparatus wherein cooling drums 1, 1 provided with a cooling mechanism in the inside thereof are provided in such a manner that the shafts are parallel to each other and a pair of side gates 2, 2 are provided in contact with the end face of said cooling drums 1, 1, thereby forming a pouring basin portion 4. A molten steel 5 is poured into the pouring basin portion 4 through a molten metal pouring nozzle 3, and the cooling drums 1, 1 are rotated in the direction of arrows a, a to cool and solidify the molten metal 5. The solidified layer is subjected to press contact at the kissing point 6 to form a thin cast strip 7.

Figure 5:
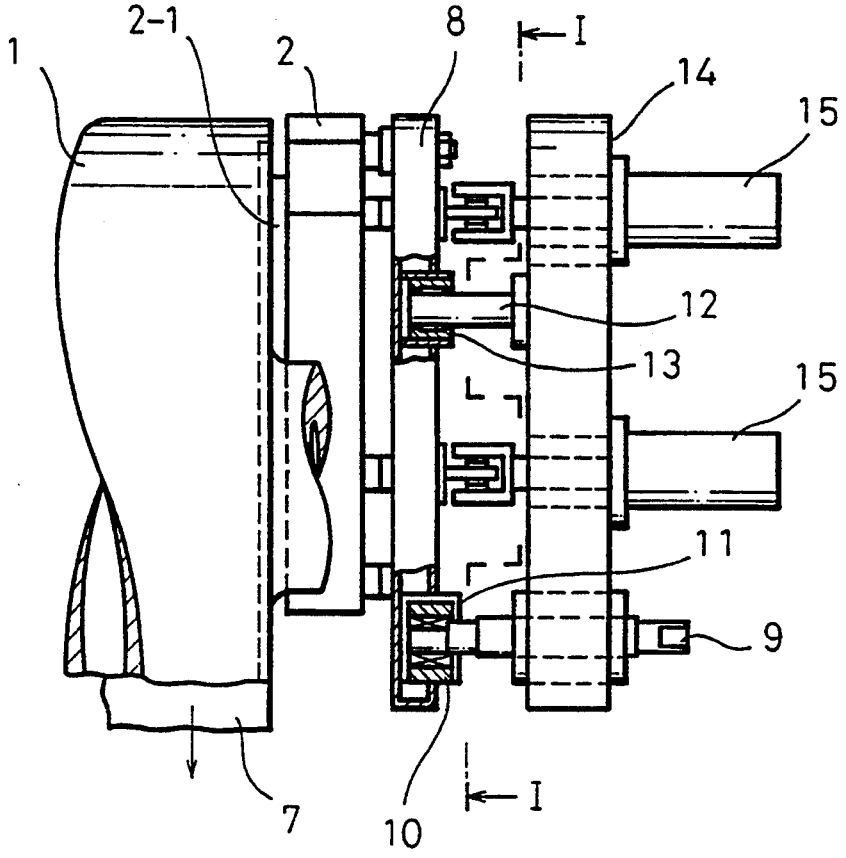
FIG. 5 is a partly broken side view of the principal portion of a vibrating device for side gates.
Figure 6:
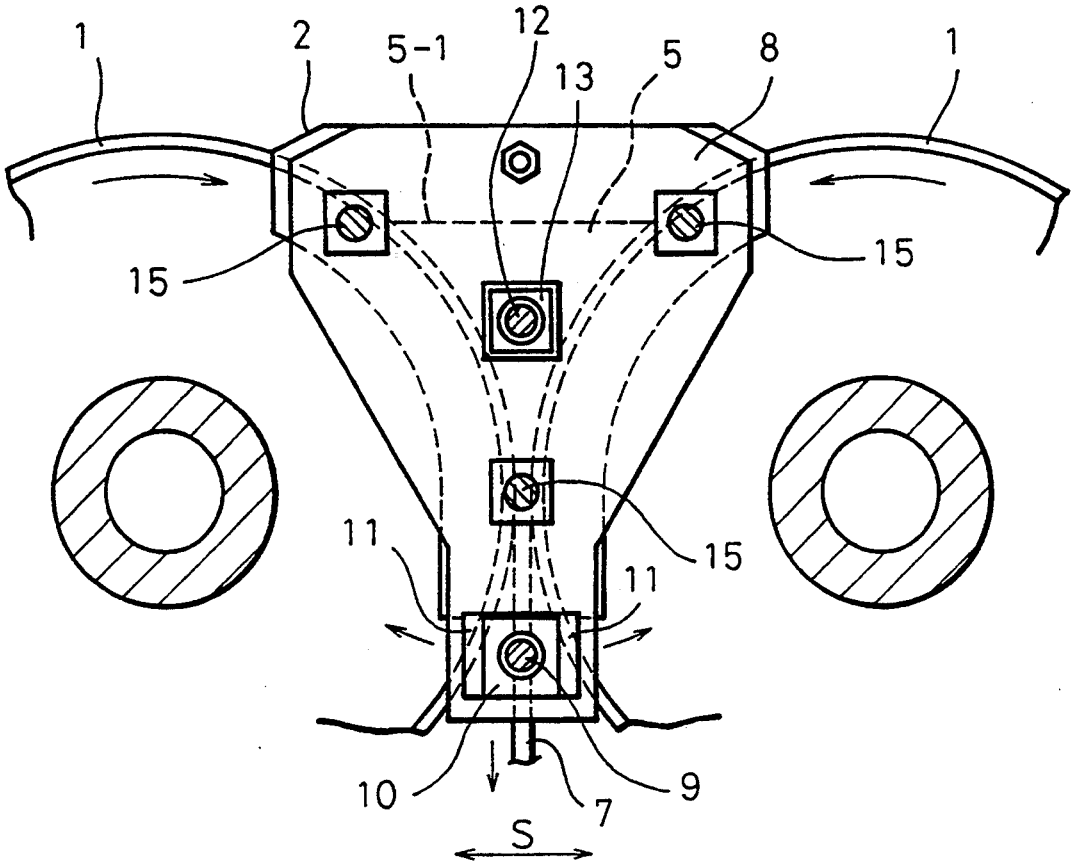
FIG. 6 is a cross-sectional view taken on line I—I of FIG. 5.

In the above-described apparatus, a laboratory apparatus used to obtain an effect of the present invention is shown in FIGS. 5 and 6. In the drawings, side gate 2 is pressed against a pair of cooling drums 1 by means of a pressing device 15 through a vibrating plate 8 to form a pouring basin portion. The cooling drums 1 are rotated while conducting slide contact with a refractory material 2-1 provided on the surface of the side gate 2. On the back face of the vibrating plate 8 for fixing the side gate 2, a bearing 3 is provided below the molten metal surface 5-1 and above the kissing point 6 of the cooling drum, preferably around the center of gravity of the side gate or the center of gravity of a surface in contact with the molten metal of the side gate, and the tip of a vibration supporting shaft 12 fixed to a frame 14 is inserted and rotatably mounted in the bearing 13. On the other hand, a guide 11 is provided below the kissing point 6 of the cooling drum, and a slider 10 is slidably fit into the guide 11. The eccentric tip of an excitation shaft 9 which is removably and rotatably supported on the frame 14 is supported on the slider 10 so that it can be rotated by the shaft. In this state, when the excitation shaft 9 is rotated by means of a drive (not shown), the slider 10 reciprocates by sliding within the guide 11. This causes the vibrating plate 8 to be moved about the vibration supporting shaft 12, thereby vibrating the side gate 2 fixed to the vibrating plate 8. Thus, vibration is imparted to the side gate 2 in a direction horizontal to an imaginary line formed by connecting the shaft centers of the cooling drums to each other.

Figure 1:
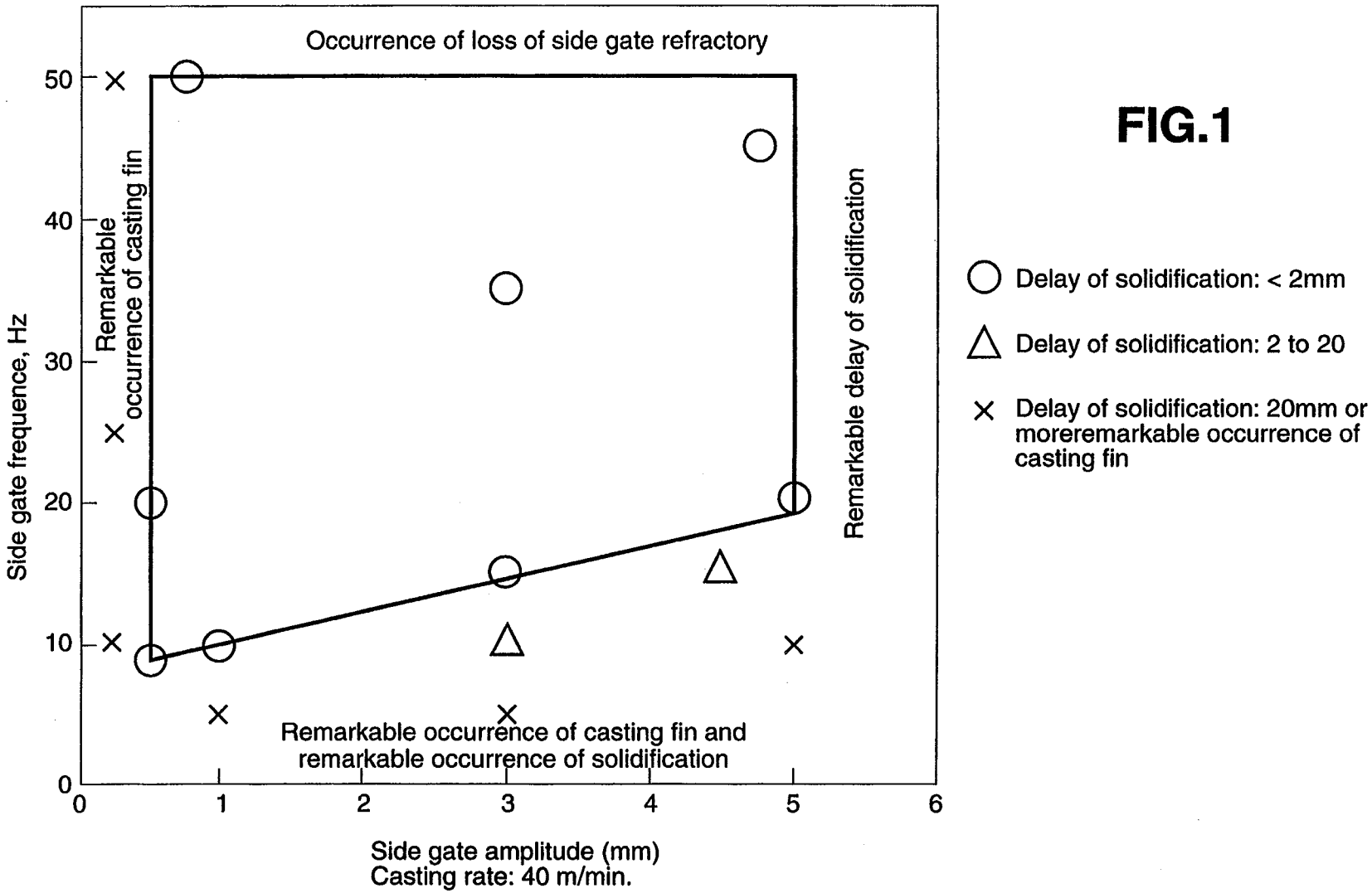
FIG. 1 is a diagram showing the relationship between the amplitude of side gate vibration, the frequency of side gate vibration and the delay of solidification when the casting rate is 40 m/min.

The present inventors have produced a thin strip by using the above laborator apparatus shown in FIG. 5 according to a process which comprises pouring a molten SUS304 austenite-based stainless steel into the pouring basin portion and subjecting the molten steel to continuous casting at a casting rate, V, of 40 m/min to produce a thin strip. In this case, the amplitude, A (mm), and the frequency, f (Hz), were varied to evaluate the delay of solidification at the end portion of a cast strip. The results are shown in FIG. 1. The delay of solidification was expressed in terms of the length of delay of solidification in the width direction of a cast strip at the end portion of the cooling drum.

As shown in the drawing, when the side gate amplitude, A, is less than 0.5 mm, it becomes difficult to peel off the solidified matter formed on the wall surface of the fixed gate, so that the occurrence of casting fin became significant. On the other hand, when the side gate amplitude exceeds 5 mm, a shear stress occurs between the cooling drum and the shell formed through the contact of the molten metal with the cooling drum, so that the shell is pulled from the cooling drum by the shear stress. This causes a delay in solidification and in turn the occurrence of porosity and a large secondary casting fin. On the other hand, when the side gate frequency, f, is less than a value determined by the following equation $$f=a\times A+b+c\times V=2\times A+5+0.1\times 40=2A+9 \quad (Hz)$$

wherein a=2, b=5 and c=0.1, it becomes difficult to peel off solidified matter formed on the wall surface of fixed gates, so that the occurrence of casting fin becomes significant, which causes the delay of solidification to become significant. When the side gate frequency, f, exceeds 50 Hz, there occurs breaking of side gate refractories which is causes operation failure.

Thus, it was found that in the above-described case, good results can be obtained by vibrating the side gates at an amplitude, A, in the range of from 0.5 to 5 mm and a frequency, f, in the range of from (2A+9) to 50 Hz. This frequency range suggests that when an increase in the amplitude, A, is intended, it is necessary to increase the frequency for the purpose of preventing peeling of the shell.

Figure 2:
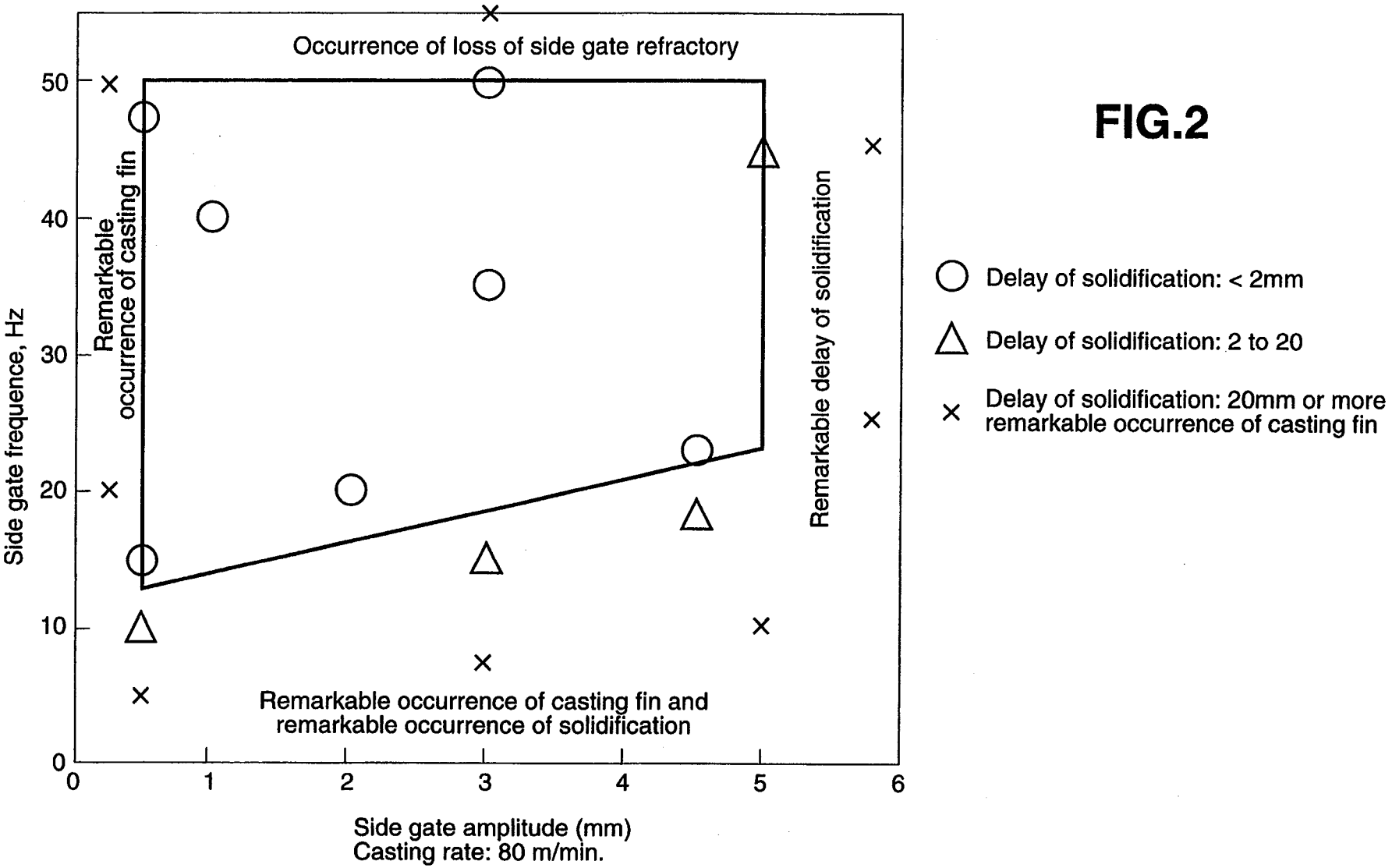
FIG. 2 is a diagram showing the relationship between the amplitude of side gate vibration, the frequency of side gate vibration and the delay of solidification when the casting rate is 80 m/min.
Figure 3:
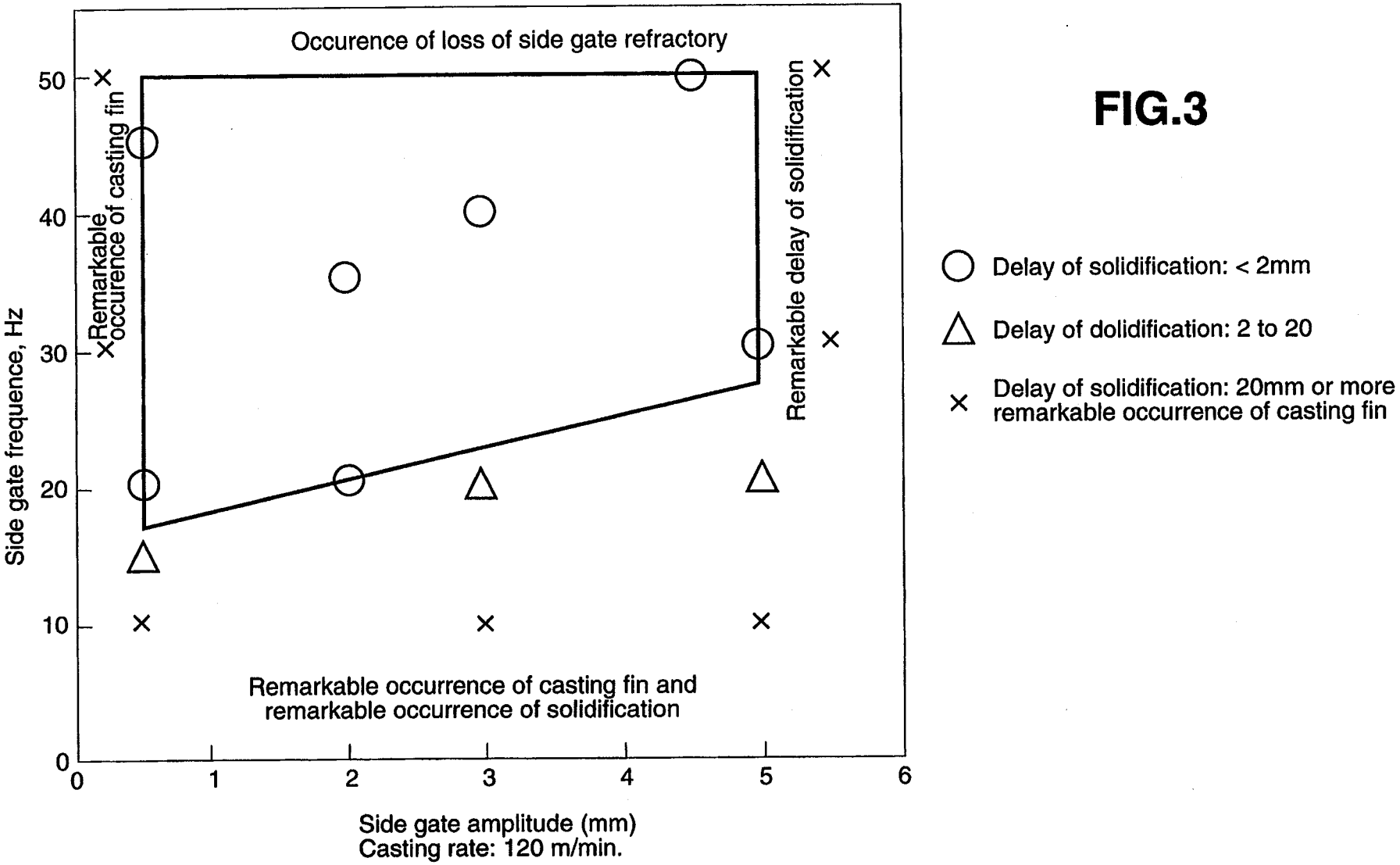
FIG. 3 is a diagram showing the relationship between the amplitude of side gate vibration, the frequency of side gate vibration and the delay of solidification when the casting rate is 120 m/min.

Then, a steel of the same type as that used above was cast at a casting rate, V, of 80 m/min. As shown in FIG. 2, the lower limit of the side gate frequencies corresponding to each side gate amplitudes was increased, so that the proper range became narrow. When the casting rate, v, was 120 m/min, as shown in FIG. 3, the lower limit of the side gate frequency was increased. Thus, when the casting rate, V, is increased, if the frequency is around the lower limit value, the frequency should be increased to a suitable frequency.

Specifically, the present invention is characterized in that the frequency of the side gate vibration, and the amplitude, at the kissing point portion are properly selected according to the casting rate. The vibration of the side gate under such a condition shortens the delay in solidification in the direction of width at the end portion of the cooling drum, which reduces the amount of trimming at the time of cold rolling, which contributes to a remarkable improvement in production yield.

The casting rate, V, is previously determined for each casting machine by determining the thickness of a sheet to be cast according to the following equation.

$$B = K\sqrt{t} \quad (2)$$

When the arc angle and the drum diameter are 40° and 1200 mm, respectively, $$B = K\sqrt{1.2/9V} \quad (3)$$

$$V = 1.2\,K^2/9B^2 \quad (4)$$

wherein K represents the coefficient of solidification, t represents the contact time and B represents a specified sheet thickness. The V value can be determined because K is a value inherent in the casting machine and B is known before casting.

Therefore, the side gate amplitude and the initial value of the frequency are determined based on the casting rate, V.

Although the present invention has been described based on SUS304 austenite stainless steel, it was confirmed through various tests that the vibration of the side gates according to the above-described equation and the above-described numerical values is very effective in suppressing the occurrence of casting fin and preventing the delay of solidification when the steel is an austenite stainless steel. Further, in other types of steel as well, the application of vibration to the side gates in substantially the same manner as that described above is effective.

EXAMPLES

Steels listed in Table 1 were cast at three casting rates, that is, 40 m/min, 80 m/min and 120 m/min into thin cast strips having thicknesses given in Table 2. The side gate vibration conditions, yields, etc. in this case are given in Table 2.

In Comparative Examples Nos. 2 and 5, the frequency relative to the amplitude was low and outside the scope of the present invention, so that the delay of the solidification was large and the yield was reduced due to an increase in the degree of trimming.

Regarding the steels used, A represents a SUS304 austenite-based stainless steel, B represents a low-carbon Al killed steel, C represents a silicon steel sheet, and D represents a ferrite-based stainless steel.

TABLE 1

| No. | C | Si | Mn | P | S | Ni | Cr | Al | O | N | Nb |
|---|---|---|---|---|---|---|---|---|---|---|---|
| A | 0.045 | 0.45 | 1.01 | 0.030 | 0.005 | 8.30 | 18.20 | 0.002 | 0.0058 | 0.0325 | 0.020 |
| B | 0.035 | 0.05 | 0.20 | 0.003 | 0.001 | 0.01 | 0.005 | 0.030 | 0.0025 | 0.0034 | 0.003 |
| C | 0.005 | 3.15 | 0.005 | 0.003 | 0.003 | 0.02 | 0.09 | 0.04 | 0.0011 | 0.0020 | 0.001 |
| C | 0.060 | 0.30 | 0.21 | 0.019 | 0.001 | 0.12 | 16.50 | 0.034 | 0.0034 | 0.0175 | 0.002 |

TABLE 2

| No. | Casting rate, m/min | Sheet thickness, mm | Side gate conditions amplitude, mm | Side gate conditions frequency, Hz | Length of delay of solidification, mm | Degree of trimming on one side, mm | Yield % | Classification | Steel used |
|---|---|---|---|---|---|---|---|---|---|
| 1 | 40 | 3.8 | 1 | 10 | 0.8 | 0 | 100 | Ex. | A |
| 2 | 40 | 3.8 | 1 | 5 | 30.0 | 35 | 91 | Comp. Ex. | A |
| 3 | 40 | 3.8 | 0.5 | 20 | 1.0 | 0 | 100 | Ex. | A |
| 4 | 40 | 3.8 | 5 | 20 | 1.5 | 0 | 100 | " | A |
| 5 | 40 | 3.8 | 3 | 10 | 25.0 | 20 | 95 | Comp. Ex. | A |
| 6 | 80 | 2.3 | 3 | 15 | 5.0 | 7 | 98 | Ex. | A |
| 7 | 80 | 2.3 | 3 | 50 | 0.5 | 0 | 100 | " | A |
| 8 | 120 | 1.8 | 3 | 50 | 1.0 | 0 | 100 | " | A |
| 9 | 40 | 3.5 | 1 | 15 | 3.4 | 5 | 98 | " | B |
| 10 | 80 | 2.2 | 3 | 50 | 1.6 | 4 | 98 | " | B |
| 11 | 40 | 3.6 | 1 | 15 | 2.4 | 4 | 98 | " | C |
| 12 | 80 | 2.4 | 3 | 50 | 1.8 | 3 | 99 | " | C |
| 13 | 40 | 3.8 | 1 | 15 | 1.7 | 3 | 99 | " | D |
| 14 | 80 | 2.3 | 3 | 50 | 0.5 | 0 | 100 | " | D |

INDUSTRIAL APPLICABILITY

As described above, according to the present invention, since no delay of solidification at the end portion of the cast strip occurs, it is unnecessary to conduct trimming, which contributes to a remarkable improvement in the yield, so that the effect of the present invention, on the production of a cast strips of stainless steels and other steels is very large.

We claim:

1. A process for producing a thin metallic strip by continuous casting, comprising forming a pouring basin portion for a molten metal between a pair of rotary cooling drums respectively having shafts parallel to each other and a pair of side gates in contact with the end faces of said cooling drums and pouring said molten metal into said pouring basin portion for a molten metal to continuously cast a thin cast strip characterized in that said casting is conducted while vibrating said side gates at a frequency, f (Hz), determined according to the following formula in a direction substantially horizontal to an imaginary line formed by connecting the shaft centers of said cooling drums to each other:

$$aA+b+cV \leqq f \leqq 50 \quad (1)$$

wherein

A is the numerical value of the amplitude (mm) of the side gate at the kissing point portion of the cooling drum and is in the range of from 0.5 to 5 mm;

V is the numerical value of the casting rate (m/min) previously determined from a desired casting sheet thickness; and a=2, b=5, and c=0.1.

2. The process according to claim 1, wherein the casting rate is detected during casting and at least one of the frequency, f, and the amplitude, A, is adjusted according to the formula (1).

* * * * *